US005182849A

United States Patent [19]

Marco

[11] Patent Number: 5,182,849

[45] Date of Patent: Feb. 2, 1993

[54] PROCESS OF MANUFACTURING LIGHTWEIGHT, LOW COST MICROWAVE COMPONENTS

[75] Inventor: Alex A. Marco, Torrance, Calif.

[73] Assignee: Hughes Aircraft Company, Los Angeles, Calif.

[21] Appl. No.: 631,826

[22] Filed: Dec. 21, 1990

[51] Int. Cl.[5] ..... H01P 11/00

[52] U.S. Cl. ..... 29/600; 164/132

[58] Field of Search ..... 29/600; 164/132, 34, 164/35, 36; 427/250, 42

[56] References Cited

U.S. PATENT DOCUMENTS

| | | | |
|---|---|---|---|
| 3,245,132 | 4/1966 | Thaler | 29/600 |
| 3,290,762 | 12/1966 | Ayuzawa et al. | 29/600 |
| 3,969,814 | 7/1976 | Toy et al. | 29/600 |
| 4,575,700 | 3/1986 | Dalman | 29/600 |
| 4,776,087 | 10/1988 | Cronin et al. | 29/600 |
| 4,947,540 | 8/1990 | Komachi | 29/600 |

FOREIGN PATENT DOCUMENTS

| | | | |
|---|---|---|---|
| 658634 | 4/1979 | U.S.S.R. | 29/600 |

*Primary Examiner*—P. W. Echols

*Attorney, Agent, or Firm*—Leonard A. Alkov; Wanda K. Denson-Low

[57] ABSTRACT

Disclosed is a method of producing a complex, lightweight, and low cost microwave waveguide components. First, a salt mandril (25) is formed into a desired shape by a compaction process. Next, an aluminum layer (50) is applied to the outer surface of the salt mandril (25) by means of a vapor deposition process. The thickness of the aluminum layer (50) can be made very thin. Plastic stiffeners (54, 56) can be added to outer walls of the aluminum layer (50) to increase the support of the waveguide walls and still maintain minimum weight. Next, the entire structure is submerged in an aqueous solution to dissolve the salt mandril (25). Machining of unwanted parts of the aluminium layer (50) can then be performed, and the inner surface of the aluminum layer (50) and exposed outer surfaces can be anodized (80). Gold plating (72) can be applied to appropriate surfaces of the aluminum layer (50) for an improved interface to attach the microwave component to other components to form a desired system. By this, complex and lightweight components can be fabricated.

25 Claims, 4 Drawing Sheets

PROCESS OF MANUFACTURING LIGHTWEIGHT, LOW COST MICROWAVE COMPONENTS

BACKGROUND OF THE INVENTION

1. Field of the Invention

Disclosed is a method of producing microwave components, and more specifically, a method of producing a thin walled, aluminum microwave waveguide.

2. Description of the Related Art

In the field of microwave systems, certain components, such as antennae, transmitters, etc. are sometimes required which incorporate complex shaped waveguides to direct the microwaves along a certain path. For obvious reasons, it is generally advantageous to have a microwave waveguide which is very lightweight, inexpensive to produce, adequately durable, highly conductive, and corrosion resistant. In addition, the metal which forms the waveguide must be capable of being readily formed into a complex shape.

The most relevant prior art of producing waveguides involves electro-forming or electroplating a surface coating of a highly conductive platable metal such as copper, nickel or silver on an appropriate substrate in an aqueous solution. A mandril shaped in a desired form from the appropriate substrate material, such as a suitable metal or graphite, is submerged in the aqueous solution and a waveguide metal is deposited by electroplating on a surface of the mandril by well known means. Electroplatable metals which have desirable corrosion resistant properties are generally expensive, i.e., noble metals, or are low cost metals, such as copper or nickel, which must be plated with the noble metals, which again are expensive and are very difficult to be plated on complex internal cavities. This process then necessarily entails a complex and expensive method to attain desirable waveguides of complex shapes.

What is needed then is a process of producing complex waveguide or microwave components which are lightweight and inexpensive to form, and provide the necessary characteristics of an effective waveguide or conductor for microwave frequencies. It is therefore an object of the present invention to provide such a process.

SUMMARY OF THE INVENTION

Disclosed is a method for forming a metal, such as aluminum, into a thin-walled complex shape for use as a microwave component, such as a waveguide. Since aluminum is not applicable for electroplating processes, a vapor deposition process is used to deposit the aluminum on an appropriate substrate to form the waveguide component. First, specially shaped compacts of salt are formed in die presses, and the individual pieces are bonded together by means of an appropriate adhesive to form the desired final shape of the waveguide. This salt compact mandril acts as a molding surface onto which the aluminum is to be deposited. Next, a conductive coating is applied to the outer surface of the salt mandril. Then, by means of a vapor deposition process, aluminum is deposited onto the conductive coating and built up to any desirable thickness to form the component. Generally, the thickness will be very thin. After the aluminum is deposited onto the salt mandril, plastic support members can be attached to the outer walls of the aluminum coating to provide added strength to the thin aluminum component. Next, the salt is dissolved from within the aluminum deposited layer by submerging the mandril in a hot water bath. Excess material can then be ground away, and the internal surfaces anodized for corrosion protection. Other areas of the aluminum waveguide walls can be plated with appropriate plating metals for providing a conductive interface for attachment to other microwave components. By this method, complex, lightweight, aluminum microwave components can be produced inexpensively, particularly on a mass production basis.

Additional objects, advantages, and features of the present invention will become apparent from the following description and appended claims, taken in conjunction with the accompanying drawings.

DETAILED DESCRIPTION OF THE PREFERRED EMBODIMENTS

Figure 1A:
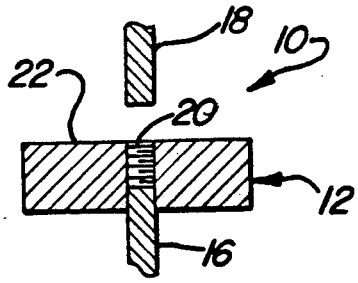
FIG. 1A–1D shows a method of producing salt compacts according to a preferred embodiment of the present invention.

The following description of the preferred embodiment is merely exemplary in nature and is in no way intended to limit the invention or its application or uses.

Disclosed is a process for forming a microwave waveguide component having low cost, excellent corrosion protection, excellent electrical conductivity, sharp square corners and no bonding discontinuities. In addition, the formed waveguide component will be of extremely light weight. The waveguide itself can be produced from substantially pure aluminum or alloys thereof to provide the above disclosed properties. To form the aluminum into the appropriate shapes, which may be extremely complex, a material is selected as a mandril for providing a surface on which the aluminum can be deposited which itself offers a number of highly desirable characteristics. Baker's salt is one material which has desirable characteristics in that it is low in cost, produces a very smooth surface finish, and is easily removed by immersion in hot water. The baker's salt is compacted into desirable shapes by presses similar to those used in the manufacture of aspirin and other compressed pills.

Turning to FIGS. 1A-1D, a typical press, shown generally at 10, to form the salt compacts is depicted. Press 10 includes a die 12 having a die cavity 14 extending completely through die 12 proximate its center, and configured in a desired shape. At the lower portion of die 12 is a bottom center punch 16, and at the upper portion of die 12 is a top center punch 18. Both center punches 16 and 18 are aligned with each other and with cavity 14. In addition, punches 16 and 18 are shaped in the appropriate form to fit within cavity 14. Die 12 further includes a top wipe surface 22.

Figure 1B:
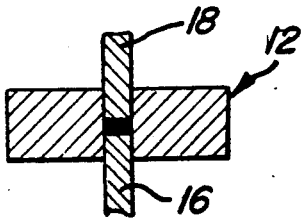
Figure 1C:
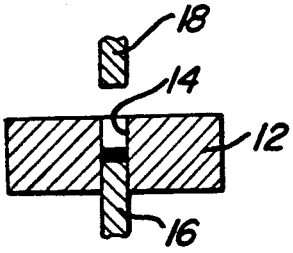
Figure 1D:
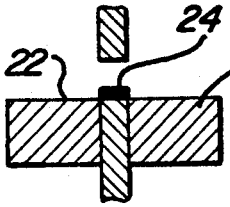

Looking specifically at FIG. 1A, bottom punch 16 is inserted into cavity 14 of center die 12, and adjusted to a depth within cavity 14 such that when a dry powder baker's salt 20 is poured into shaped cavity 14 from the top, and the excess is wiped away flush with top surface 22, the exact amount of salt 20 remains in die 12 to produce a desired salt compact 24. The top punch 18 is then moved downward into shaped cavity 14 to compact the baker's salt 20, as shown in FIG. 1B. After salt 20 is compacted, top punch 18 is withdrawn from center die 12 well above top surface 22, as shown in FIG. 1C. Baker's salt 20 has been compressed under high pressure into a solid form having the desired shape and dimensions, and will be retained in this form under reasonable handling. Bottom punch 16 is then pushed up through the remaining distance of shaped cavity 14 until the top surface of bottom punch 16 is substantially flush with top surface 22 of die 12, such that the compressed compact of salt 24 can be removed, as shown in FIG. 1D.

Figure 2:
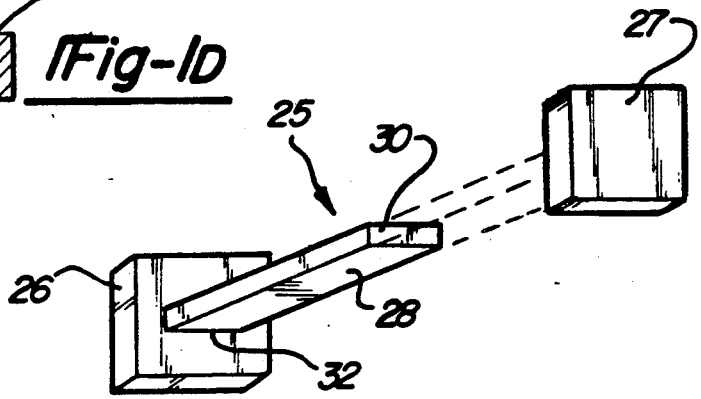
FIG. 2 shows the compacts of FIG. 1 arranged for bonding in a particular fashion.

A simple waveguide structure comprising a compacted salt mandril assembly 25 is shown in FIG. 2. Mandril 25 is formed from three separate salt compacts 24 from three separate pressings of press 10 using an appropriate die 12. These salt compacts are two identical flange salt compacts 26 and 27, and a waveguide salt compact 28. The three salt compacts 26, 27 and 28 are adhered together in the configuration as shown in FIG. 2. Generally, a nonaqueous adhesive which can withstand temperatures of 300° C. or higher, and is dissolvable in a solvent after curing, is applied to salt compacts 26, 27 and 28 to form adhesive bond lines 30 and 32, and thus, hold mandril 25 in the configuration as shown.

To form the waveguide itself, a waveguide metal must be coated on mandril 25. Aluminum, the choice material for the waveguide, cannot be electroplated or electroless plated onto an object from an aqueous bath as many other waveguide metals can. However, aluminum can be deposited by various vapor deposition techniques. These deposition methods include chemical vapor deposition (CVD) by which an aluminum containing gas decomposes on a hot substrate surface leaving an aluminum film. The film can be built up to any thickness. A further method includes physical vapor deposition (PVD) by which an aluminum wire is vaporized by a positive electrical charge, and the vapor is deposited on a substrate having a negative electrical charge. A third vapor deposition method is ion vapor deposition (IVD), which includes substantially the same process as the PVD method. Generally, the PVD or IVD processes are preferred over the CVD process. This is because the CVD mandril must be heated to such a degree to cause the aluminum containing gas to decompose and deposit the aluminum on the mandril surfaces. However, the CVD process does not require the mandril to be conductively coated.

Figure 3:
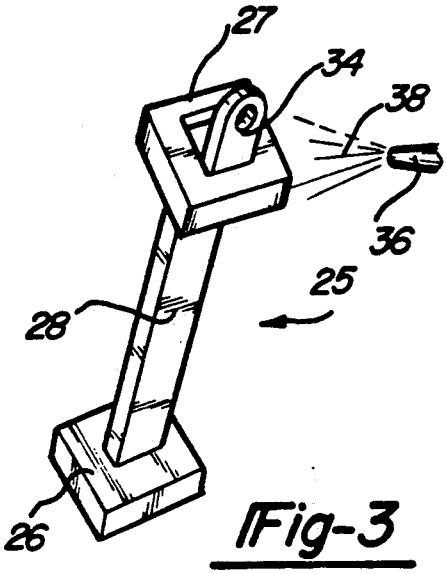
FIG. 3 shows the compacts of FIG. 2 being sprayed with an electrically conductive coating.

Both the PVD and IVD processes require the substrate, i.e., the salt compacts, to have a conductive surface in order to accept an electrical charge. Turning to FIG. 3, mandril 25 has been formed as shown in FIG. 2, and further, has been affixed with a hanging hook 34 at a top surface of salt compact 27. A nozzle 36 administers a conductive coating 38 in a spray form to mandril 25 in order to coat mandril 25 with a conductive, nonaqueous paint which can withstand the process temperatures, and be capable of easily being washed off with an appropriate solvent. Generally, mandril 25 will be applied with an even, very thin coating of conductive paint 38 over its entire outer surface.

Figure 4:
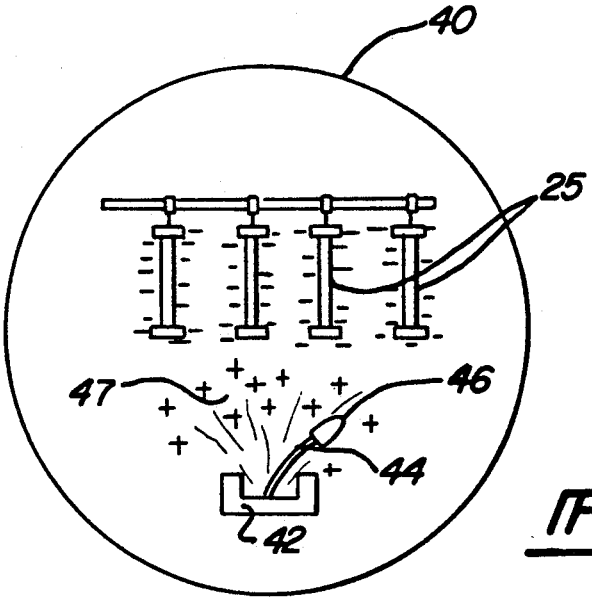
FIG. 4 shows an aluminum deposition process according to a preferred embodiment of the present invention.

After mandril 25 has been coated with conductive paint 38, it is next subjected to an aluminum deposition process for forming a layer of aluminum on mandril 25. FIG. 4 shows an aluminum ion vapor deposition process in which a plurality of mandrils 25 are positioned in an ion vapor deposition chamber 40. A negative charge is applied to each mandril 25 to apply a negative polarity to the conductive paint coating 38 by means well known to those skilled in the art.

In the ion vapor deposition process, a crucible 42 is heated while a feeder nozzle 46 continuously feeds solid aluminum wire into crucible 42, both feeder nozzle 46 and an aluminum wire 44 having a positive charge. As wire 44 contacts hot crucible 42, the wire 44 melts and vaporizes at the point of contact producing vapor ions 47 having a positive electrical charge. The negatively charged mandrils 25 attract the positive ions 48 to form a relatively even coating of aluminum except for a slightly greater thicknesses on the corners of mandrils 25. This additional thickness on the corners is desirable both electrically and structurally. The process can continue until the desired thickness of aluminum is applied to the surface of mandrils 25.

In IVD and PVD it is possible to first feed pure aluminum wire into crucible 42 until the deposition of pure aluminum on the mandril is approximately a thousandth of an inch thick, and then feed alloys of aluminum into crucible 42, including those of lithium or boron, to provide for the majority of the wall thickness. Finally, pure aluminum is again fed into crucible 42 for the last thousandth of an inch to provide for the outer surface. The net result is a sandwich material having the corrosion protection of anodized pure aluminum and the strength of alloyed aluminum. Additionally, IVD and PVD are not limited to aluminum, but a host of other metals and alloys as well.

Figure 5:
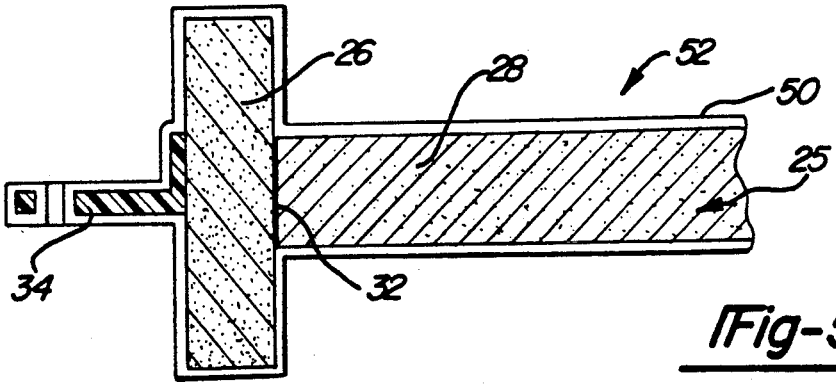
FIG. 5 shows a cross-sectional view according to a first preferred embodiment of the present invention after the aluminum deposition stage.

Now turning to FIG. 5, a cross section of an aluminum deposited mandril 52 is shown. Aluminum deposited mandril 52 includes salt mandril 25, and an aluminum layer 50 applied to mandril 25 by the ion vapor deposition process of FIG. 4. In addition, hanger 34 has also been deposited with aluminum. In this figure, only flange salt compact 26 and part of waveguide salt compact 28 is shown. Adhesive bond line 32 is also shown.

Figure 6:
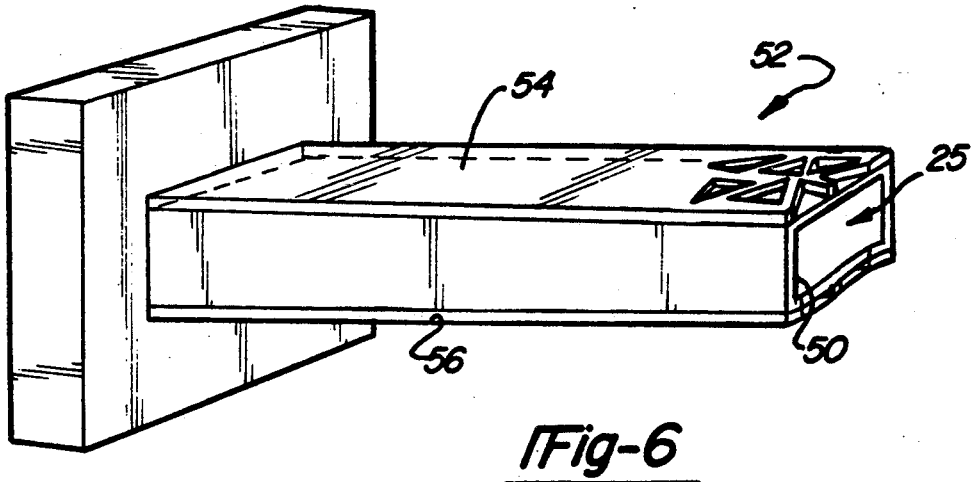
FIG. 6 shows a perspective view of the first preferred embodiment of the present invention incorporating plastic support stiffeners.

If in the desired end waveguide product the weight of the waveguide is not critical, the deposition process could continue until a thickness of the aluminum layer 50 on salt mandril 25 had a thickness applicable to withstand whatever was necessary to survive the intended use of the final waveguide product. However, where minimum weight is important, aluminum layer 50 can be deposited extremely thin. Practical deposition and usage thicknesses of aluminum layer 50 can be between 0.010 and 0.015 inches. In these thin applications, plastic stiffeners shown generally at 54 and 56 of FIG. 6, can be positioned on aluminum coating 50 to increase the strength and stiffness of the waveguide walls. Plastic stiffeners 54 and 56 are in a lattice like configuration (as partly shown in FIG. 6) to further reduce the weight, and are cut to the desired size of the aluminum coated mandril 52. Likewise, plastic stiffeners (not shown) could be bonded to the narrow walls of the waveguide perpendicular to stiffeners 54 and 56. This would depend on the width, configuration, and possible pressurized conditions in the end use of the waveguide component. The plastic stiffeners 54 and 56 are generally injection molded pieces that are tailored to fit a given size of a particular waveguide. The material used for the plastic stiffeners should have a coefficient of thermal expansion as close as possible to that of aluminum ($13.1\times10^6$), and have the highest possible flexure modulus as a secondary consideration. This results in low physical distortion through wide temperature ranges, and low deformation when physical loads are applied to the waveguide. Plastic stiffeners 54 and 56 are generally bonded by an appropriate adhesive to opposite surfaces of the aluminum walls, represented by aluminum layer 50, before removal of salt mandril 25 (as shown in FIG. 6), because if salt mandril 25 was first removed the aluminum layer 50 would be too fragile to be handled without a support structure, and would become deformed before the plastic stiffeners could be applied.

Figure 7:
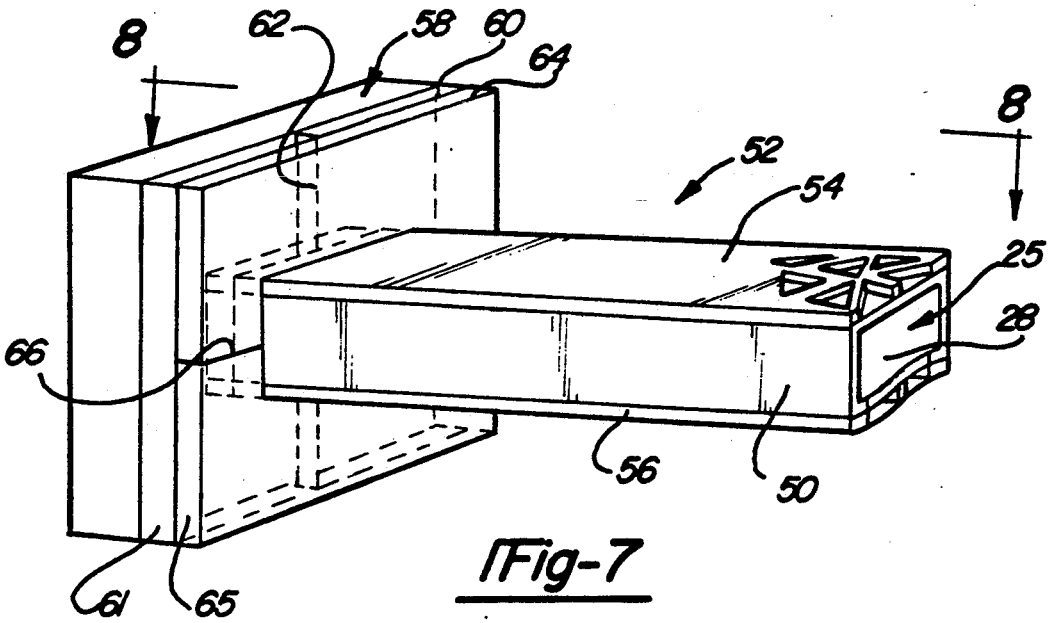
FIG. 7 shows a perspective view according to the first preferred embodiment of the present invention showing additional plastic flange stiffeners.

Now turning to FIG. 7, additional plastic stiffeners are shown bonded to waveguide structure 52. Flange portion 58, which is flange salt compact 26 having aluminum layer 50, is shown having a double layer of plastic stiffeners. In this embodiment, the first layer is comprised of two plastic flange stiffener halves 60 and 61, which have been bonded to each other along bond line 62. A suitable adhesive is used to bond the two plastic flange stiffeners 60 and 61 together, and to flange portion 58. Stiffeners 60 and 61 are positioned on the surface of flange portion 58 adjacent the end of salt compact 28, and thus overlap the ends of stiffeners 54 and 56 as shown. In addition, a second layer comprised of plastic flange stiffener halves 64 and 65 is bonded to the first layer, comprised of plastic flange stiffeners 60 and 61, along a second bond line 66, also by the same adhesive. Bond line 66 is perpendicular to bond line 62 in this embodiment for added strength. Also, similar flange stiffeners could be applied to the opposite end of structure 52 at salt compact 27.

Figure 8:
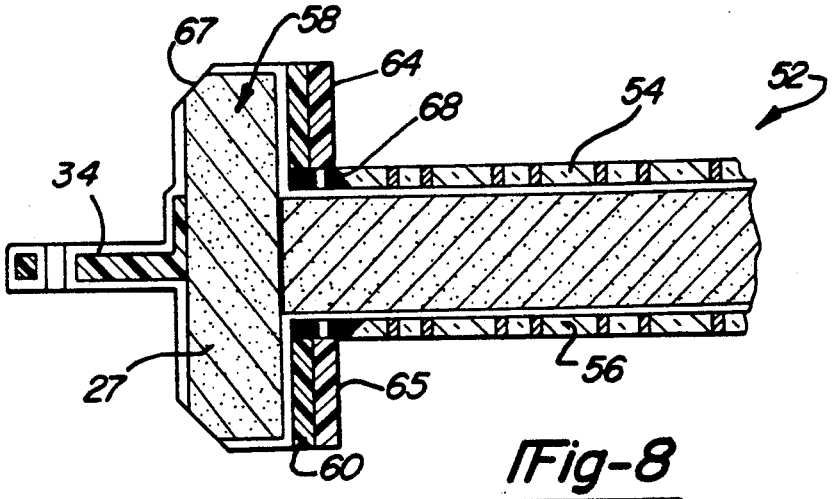
FIG. 8 shows a cut-away view of the perspective view of FIG. 7 with partial exposure of the flange salt compact.

FIG. 8 shows a cross sectional view of the waveguide structure 52 of FIG. 7 in which part of the excess material has been removed by grinding or machining, etc. The removal of the material is shown at location 67 of flange portion 58 which is an edge between the surface of flange portion 58 having hanger 34, and each of the side surfaces of flange portion 58. The salt compact 26 of mandril 25 is now exposed at this location. Flange stiffeners 60, 64, and 65 are shown overlapping wall lattice stiffeners 54 and 56, and an adhesive 68 is shown to bond these stiffeners together. In this view, it is apparent that hanger 34 is still attached to structure 52.

Figure 9:
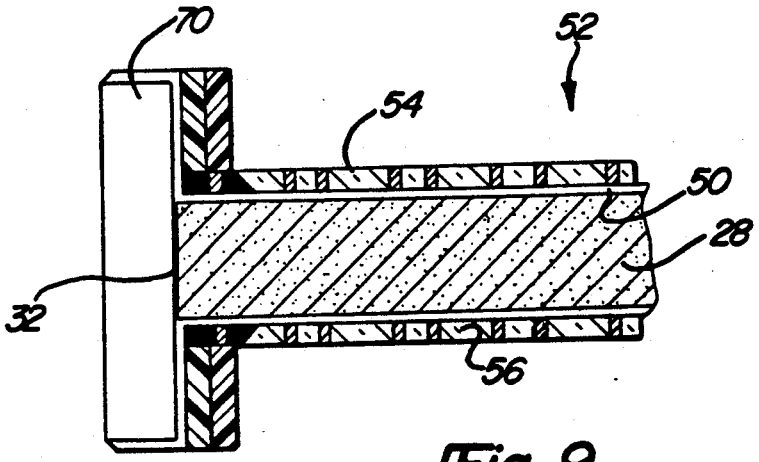
FIG. 9 shows a cut-away view of the embodiment of FIG. 8 with the flange mandril removed.

Now turning to FIG. 9, the same cross sectional view of structure 52 as that shown in FIG. 8 is shown after structure 52 has been immersed in hot water to dissolve salt compact 26 of flange portion 58. The salt is dissolved from structure 52 up to bond line 32 where salt compact 28 was initially bonded to salt compact 26 to form mandril 25. Since the area 67 had been ground off, and the salt had been exposed in the previous step, the hanger 34 and surrounding aluminum is unsupported when the salt of flange 26 is dissolved, and thus is also removed. The excess aluminum coating material, shown generally at 70, is removed by a grinding or machining process. Since hot water will not dissolve the adhesive used to attach salt compact 26 to salt compact 28, bond line 32 must be penetrated by appropriate means in order to expose the salt represented by salt compact 28. The structure 52 is again immersed in hot water to remove this remaining salt. The same procedure is followed at the other end of structure 52 for salt compact 27. The remaining adhesive of bond lines 30 and 32 is also dissolved by an appropriate nonaqueous solvent.

Figure 10:
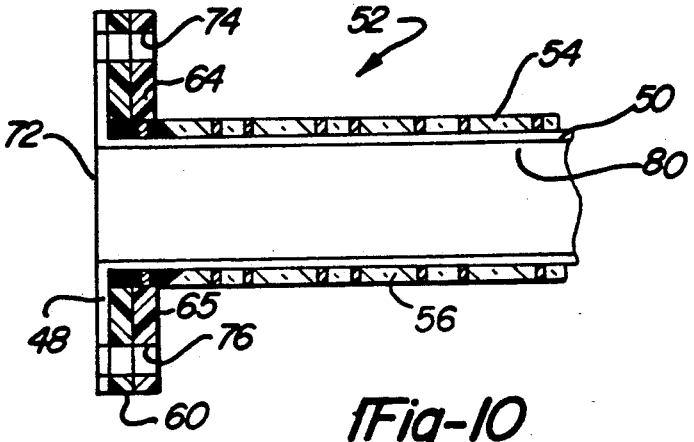
FIG. 10 shows a cut-away view of the embodiment of FIG. 9 in which the inner mandril has been removed.

FIG. 10 shows a cross-section of structure 52 after the entire salt mandril 25 has been removed. A flange template or drill fixture (not shown), having a desirable configuration of holes, is placed over structure 52 adjacent the portion of aluminum layer 50, represented by aluminum flange layer 48, in contact with plastic stiffener 60 such that fastening or guide holes 74 and 76 can be machined or drilled into plastic stiffeners 60, 64, and 65, as shown. Although flange stiffener 61 is not shown in this view, it is still machined or drilled in the same manner by using the template or drill fixture. In addition, masking of the flange faces can be achieved by painting or taping the flange faces with dielectric materials manufactured specifically for this purpose. If tape is used the waveguide openings must be cut away at the intersection of the flange surface 48 and the waveguide surfaces.

Structure 52 is then anodized, by well known means to those skilled in the art, to produce a protective aluminum oxide surface 80 on the inside of aluminum layer 50 forming the waveguide walls, as well as the outside of aluminum layer 50 not obstructed by plastic stiffeners 54 and 56. The flange masks are removed after anodizing by means applicable to the type of masking used such that the outer surface of aluminum flange layer 48 is exposed unanodized aluminum. After the anodization process, it may be desirable to gold plate the aluminum flange layer 48 to form a good conductive mating surface for attachment to other microwave components. Since this surface was not anodized it is still an electrically conductive surface such that when structure 52 is placed in a gold electroplating tank, aluminum flange layer 48 will be gold plated. Since the anodized area is a non-conductor, gold plating will not be deposited over the anodizing. Gold plating 72 is shown in FIG. 10. Although gold and bare aluminum in contact with each other produce a highly galvanic corrosive condition, that is not the case here. Since there is no bare exposed aluminum, the gold contacts only the aluminum oxide surface 80, a non-conductor, such that a galvanic couple does not exist. Structure 52 is now ready to be incorporated into the appropriate microwave system.

The salt mandril sub-assemblies discussed above have been produced by die pressing. This process is advantageous for production runs, but for prototypes the individual sub-assemblies may be machined from a large salt compact. For example, it may be desirable to compact the largest straight waveguide section possible and then machine all smaller straight sections from it. In contrast, a long straight run may be made up by bonding several smaller straight sections together. Salt compacts are easily machined provided the salt is dried before compaction, stored in a sealed container with desiccant and machined dry. The assembled salt mandril must be vacuum baked prior to any aluminum vapor deposition to prevent outgassing which reduces the quality of the aluminum coating.

This process has good results particularly if the waveguide or microwave components are required to be lightweight. For more complicated waveguides, it is sometimes a requirement that an additional prefabricated metal insert must be installed at the bonding stage.

Figure 11:
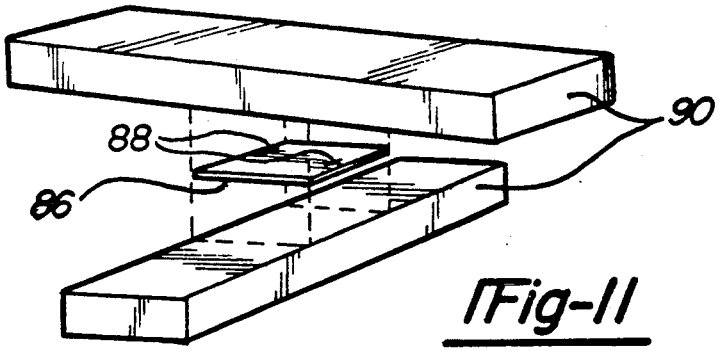
FIG. 11 shows an exploded view of a second preferred embodiment of the present invention.

FIG. 11 shows the main elements of a well known cross guide coupler type waveguide incorporating a metal insert 86. Insert 86 can be made of any of several metals, but it is believed that aluminum and its alloys would be best for vapor deposition adhesion and thermal expansion properties. In most cases it is highly desirable to have metal insert 86 at a minimum thickness. A minimal thickness insert has its advantages in cost and weight reduction. Returning to FIG. 11, two salt compacts 90, which have been conductively painted in the process described above for FIG. 3, are bonded together substantially perpendicular. Metal insert 86 having coupling slots 88 for electrical reasons, is positioned and bonded between the two salt compacts 90.

Figure 12:
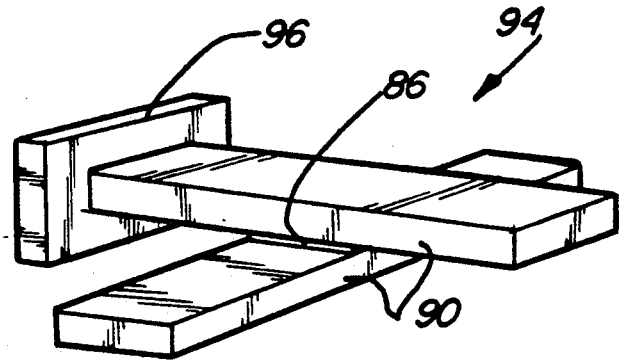
FIG. 12 shows the second preferred embodiment of the present invention during the bonding stage.

FIG. 12 shows the bonded structure 94 after the process of FIG. 11 is completed, and including a flange salt compact 96 as described above for flange 26. After the bonding structure 94 is cured, structure 94 is coated with aluminum by vapor deposition as previously described, and bonded with waveguide wall stiffeners and flange stiffeners. Salt removal and clean-up of adhesive bond lines and conductive coatings is achieved by hot water immersion and appropriate solvents after which masking, anodizing and gold plating is done as described above.

Figure 13A:
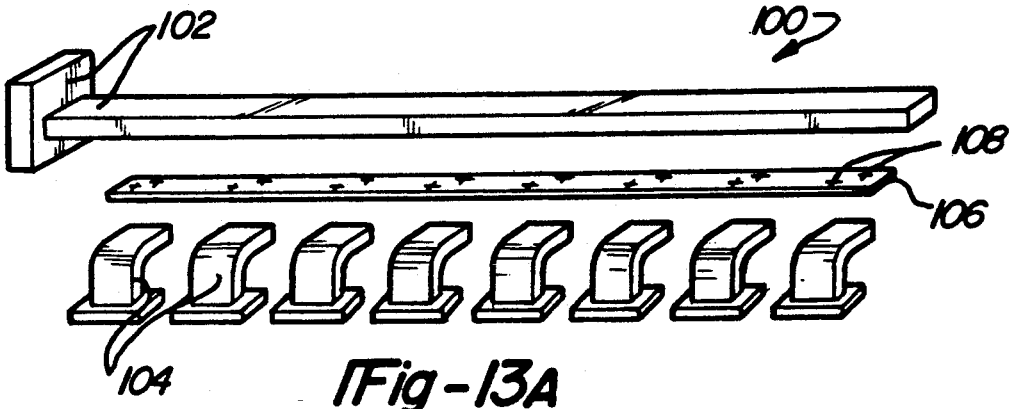
FIGS. 13A–13B shows a third preferred embodiment of the present invention in an exploded view and an assembled view, respectively.
Figure 13B:
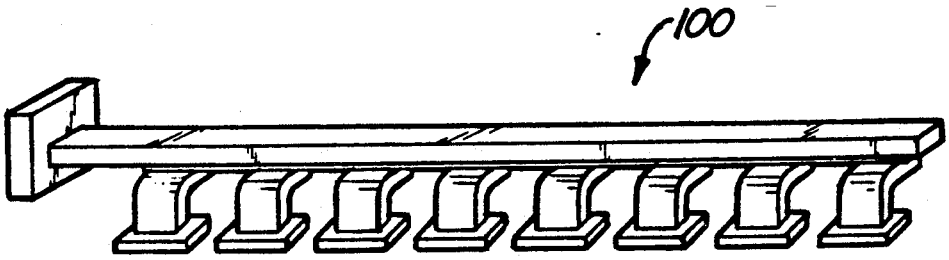

FIGS. 13A and 13B show the production steps of an even more complicated waveguide component, here a traveling wave feed mandril assembly 100. Traveling wave feed mandril assembly 100 includes conductively coated bonded salt compacts 102, which are shaped in the manner described above, and conductively coated bonded salt compacts 104 at eight locations and shaped in an L configuration. A metal insert 106 having coupling slots 108 at the appropriate location, is positioned between salt compacts 102 and the eight salt compacts 104 as shown. FIG. 13B shows the completed mandril assembly which is ready for aluminum deposition and subsequent processes as described above. Although the shapes of all the waveguide components which can be fabricated using this process are different, substantially the same process steps are used to convert salt compact assemblies into fully finished waveguide products.

The ability to compact salt into a variety of different size and shaped objects is an important consideration of the present invention. In practice, the waveguide portion of a particularly shaped waveguide components is designed for a particular microwave frequency. Clearly then the same shaped waveguide could be easily modified to accommodate different frequency microwaves. In addition, waveguide transition components can be efficiently made by the above described process. These transition components include, but are not limited to, a coax to waveguide transition component and a rectangular to circular waveguide transition components. Other components which are applicable to the above-described fabrication process include a magic tee; a precision fixed attenuator; and a short slot hybrid waveguide. These components are presently fabricated by dip brazing or investment casting. Consequently, the cost effectiveness of producing a plurality of families of waveguides is apparent.

The foregoing discussion discloses and describes merely exemplary embodiments of the present invention. One skilled in the art will readily recognize from such discussion, and from the accompanying drawings and claims that various changes, modifications and variations can be made therein without departing from the spirit and scope of the invention as defined in the following claims.

What is claimed is:

1. A process of fabricating a microwave component comprising the steps of:

forming a dissolvable mandril from salt into a desired shape;

forming a conductive layer on the outer surfaces of the mandril;

dissolving the mandril in an aqueous solution; and applying an anodized coating to the conductive layer.

2. The process according to claim 1 wherein the step of forming a conductive layer includes applying a conductive, non-aqueous paint to the mandril and then applying an aluminum outer layer to the conductive paint by a vapor deposition process.

3. The process according to claim 1 wherein the step of forming the conductive layer includes heating the mandril and applying an aluminum layer to the mandril by a vapor deposition process.

4. The process according to claim 1 further comprising the step of affixing a support member to an outer surface of the conductive layer.

5. The process according to claim 4 wherein the step of affixing a support member includes affixing plastic stiffeners configured in a lattice shape on opposite walls of the waveguide component.

6. The process according to claim 4 wherein the step of affixing a support member includes affixing plastic stiffeners to a flange portion of the waveguide component.

7. The process according to claim 1 further comprising the step of depositing a conductive member onto a surface of the conductive layer to provide a surface for attaching other microwave components.

8. The process according to claim 1 wherein the salt mandril is formed by a compacting process in a die press.

9. The process according to claim 8 wherein the salt mandril is formed from a plurality of salt compacts.

10. A method of producing a microwave component comprising the steps of:

forming a dissolvable mandril by compacting a salt in a die press in a desired shape;

vapor depositing a metal on the dissolvable mandril; and dissolving the mandril.

11. The method according to claim 10 wherein the mandril is formed by adhering a plurality of salt compacts together in a desired shape.

12. The method according to claim 10 wherein the step of depositing a metal on the mandril includes coating the mandril with a conductive, non-aqueous paint and then applying an aluminum outer layer to the conductive paint by means of a vapor deposition process.

13. The method according to claim 10 wherein the step of depositing a metal on the mandril includes heating the mandril and applying an aluminum layer to the mandril by a chemical vapor deposition process.

14. The method according to claim 10 further comprising the step of affixing a support member to a nonusable surface of the mandril.

15. The method according to claim 14 wherein the step of affixing a support member includes affixing a lattice shaped plastic member to an outer surface of the deposited metal.

16. The method according to claim 10 wherein the step of dissolving the mandril includes dissolving the mandril in an aqueous solution.

17. The method according to claim 10 further comprising the step of anodizing the metal after the mandril has been dissolved.

18. The method according to claim 10 further comprising the step of plating a layer of corrosion resisting conductive metal to the deposited metal to provide for an improved interface surface for attaching to other microwave components.

19. A process of fabricating a waveguide component comprising the steps of:

forming a dissolvable mandril from a first flange salt compact, a second flange salt compact and a waveguide salt compact;

adhering the first flange salt compact to one end of the waveguide salt compact and the second flange compact to an opposite end of the waveguide salt compact;

forming a metal layer on the outer surfaces of the mandril; and dissolving the salt mandril in an aqueous solution.

20. The process according to claim 19 further comprising the step of adhering a support member to a surface of at least one of the conductively coated flange salt compacts on an outer surface of the metal layer on the waveguide compact side of the at least one flange compact before dissolving the salt mandril.

21. The process according to claim 20 further comprising the steps of applying a template to the metal layer opposite the support member after removal of the salt of the salt mandril, and configuring holes in the metal layer and the support member by means of holes in the template.

22. The process according to claim 19 further comprising the step of adhering support members to opposite walls of the metal layer on the waveguide compact before dissolving the salt mandril.

23. The process according to claim 19 further comprising the step of anodizing the metal layer of the waveguide component after the salt mandril has been dissolved.

24. The process according to claim 19 further comprising the step of plating the metal layer adjacent the support member with a noble metal.

25. The process according to claim 19 further comprising the step of masking selected areas of the waveguide component, anodizing all exposed areas of metal of the waveguide component, removing the masking, and plating with a nobel metal those areas that had been masked.

* * * * *